United States Patent [19]

Colognori

[11] 4,326,321

[45] Apr. 27, 1982

[54] EXPANDING SLEEVE FOR WRIST BAND CONNECTOR

[75] Inventor: Aldo Colognori, 69 Lawton Ave., Cliffside Park, N.J. 07010

[73] Assignees: Aldo Colognori; Sebastian Zuptichini, both of Cliffside; Thomas McBride, Washington Township, all of N.J.

[21] Appl. No.: 158,170

[22] Filed: Jun. 10, 1980

[51] Int. Cl.[3] ..... A44C 5/18

[52] U.S. Cl. ..... 24/265 B; 16/229; 16/380

[58] Field of Search ..... 24/265 R, 265 B, 265 WS; 16/168, 169; 224/177

[56] References Cited

U.S. PATENT DOCUMENTS

| | | | |
|---|---|---|---|
| 1,447,718 | 3/1923 | Gruen | 24/265 B |
| 1,498,070 | 6/1924 | Beucke | 24/265 B |
| 1,498,109 | 6/1924 | Mulholland | 24/265 B |
| 1,704,795 | 3/1929 | Heileman | 24/265 WS |
| 2,536,007 | 12/1950 | Milner | 24/265 B |
| 2,741,139 | 4/1956 | Krekeler | 16/169 X |
| 2,774,098 | 12/1956 | Tieri | 16/169 X |
| 3,605,212 | 9/1971 | Brunner | 24/265 B X |
| 3,740,804 | 6/1973 | Levinger | 24/265 B X |
| 3,755,852 | 9/1973 | Greene | 16/169 X |
| 3,766,599 | 10/1973 | Ullman | 16/169 X |

FOREIGN PATENT DOCUMENTS

| | | | |
|---|---|---|---|
| 137190 | 5/1915 | Fed. Rep. of Germany | 16/169 |
| 517483 | 2/1931 | Fed. Rep. of Germany | 16/169 |
| 164994 | 10/1958 | Sweden | 16/168 |
| 360667 | 11/1931 | United Kingdom | 16/168 |

*Primary Examiner*—Thomas J. Holko
*Attorney, Agent, or Firm*—Ralph R. Roberts

[57] ABSTRACT

There is provided a safety sleeve and retainer of thin tubing which is of a size to provide a snug fit with the outer diameter of a pivot pin post as used with a watch band or strap. The sleeve is formed with at least a portion made with a tubular configuration and with about one-half made with a split. This split portion is expanded outwardly to form extending leaf portions. The safety sleeve is of rigid plastic or metal with a thin wall. The safety sleeve is adapted to retain the pivot pin post while the expanded leaf portions are a snugly slidable interference fit within a loop end of a strap or band. The safety sleeve is shown in two modes of construction. A preferred sleeve is made to enclose a previously provided spring pivot pin post. In the other embodiment the safety sleeve is secured to the outer portion of the pivot pin post and is used as an assembly.

7 Claims, 9 Drawing Figures

EXPANDING SLEEVE FOR WRIST BAND CONNECTOR

BACKGROUND OF THE INVENTION

1. Field of the Invention

With reference to the classification of art as established in and by the United States Patent Office the present invention is believed to be found in the General Class entitled, "Buttons, Buckles, Clamps, Etc." (Class 24) and more particularly to the subclass entitled, "Strap-end-attaching devices" (subclass 265).

2. Description of the Prior Art

The use of wrist watches and replaceable bands are more than a half century old. The wrist watch required replacement or exchange of bands for many reasons. Replacement or exchange by the jeweler attendant needs and uses a pin post or cross bar with a spring means adapted to urge the pin ends thereof into holes in ear portions of the watch case. Many attempts have been made for providing retaining means for these pins as they are placed within the hook or loop formed in each end of the strap.

A careful pre-Ex search of the art found that the problem of retaining a pin in the loop or end of the band has not been solved. Although spring pins are well known, they are a very loose fit in the loops formed in the end of the band. These pins being of small size and having spring means often are lost during inserting and securing the band to the watch. Three patents of note are U.S. Pat. No. 1,696,577 to KESTENMANN as issued on Dec. 25, 1928; U.S. Pat. No. 1,704,795 to HEILMAN as issued Mar. 12, 1929 and U.S. Pat. No. 2,870,511 to SAND as issued Jan. 27, 1959. In these and other concepts, either patented or used by the industry, the use of an expansible sleeve to hold the spring actuated pins in place is not known.

SUMMARY OF THE INVENTION

This invention may be summarized, at least in part, with reference to its objects. It is an object of this invention to provide, and it does provide, an inexpensive thin spring-like cover or sleeve which is attached to the pin to retain the pin during the time of mounting and use.

It is a further object of this invention to provide, and it does provide, an inexpensive spring-like sleeve that is sized to be a snug fit on a spring pin. The added sleeve has one end that is expanded so as to be a snug fit in the bore of the band end loops.

In brief, the spring pin customarily used to hold watch bands to wrist watches is mounted in a very thin plastic or metal sleeve. This sleeve has one end turned inwardly to form a stop shoulder while the other end is split and bent outwardly into outwardly extending sleeve portions. This sleeve may be a loose part that is slid onto a spring pin and with the closed end slid into the loop of a band secured by a spring pin in a mounted position. In another embodiment the spring, metal ends and sleeve are assembled with the spring-like outer sleeve retainer to form and provide a one-piece assembly. Whatever the embodiment the outer sleeve is of very thin tubing of substantially rigid plastic or thin inexpensive metal. Very thin spring-type stainless steel may be used since the stainless is not susceptible to moisture nor is plastic material where and when used.

In addition to the above summary the following disclosure is detailed to insure adequacy and aid in understanding of the invention. This disclosure, however, it is not intended to cover each new inventive concept no matter how it may later be disguised by variations in form or additions of further improvements. For this reason there has been chosen two specific embodiments of an expanding sleeve for a watch band connector as adopted for use with wrist watches and showing a preferred means for retaining the spring-type pivot pins used to retain the bands to a wrist watch. These specific embodiments have been chosen for the purposes of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members throughout the nine figures of the drawing.

DESCRIPTION OF THE EMBODIMENT OF FIGS. 1 THROUGH 6

Figure 1:
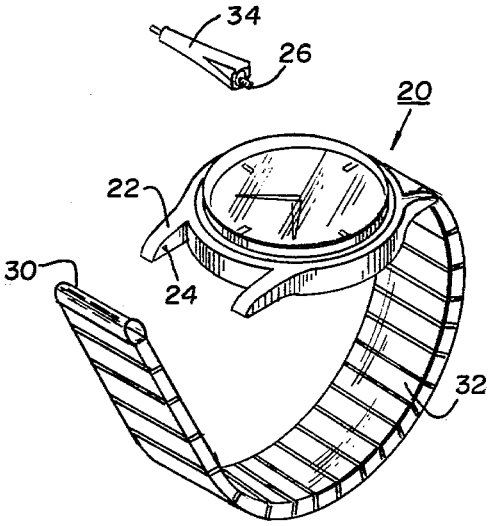
FIG. 1 represents a perspective view, partly diagrammatic, of a wrist watch and expansible band with one end of the band unattached and a spring pivot retaining pin post shown with the expansible sleeve of this invention.
Figure 2:
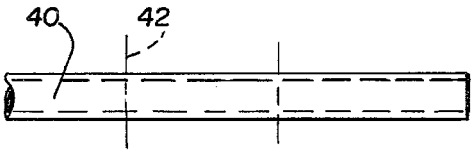
FIG. 2 represents a side view, partly diagrammatic, and showing a length of tubing that is cut to selected short lengths.
Figure 3:
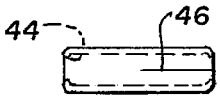
FIG. 3 represents a single length of tubing with the ends turned inwardly and with the sleeve retainer having a slit for expansion of one end thereof.
Figure 4:
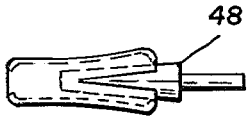
FIG. 4 represents a side view of the sleeve retainer and expansion means for insertion of the spring pivot pin in a watch band.
Figure 5:
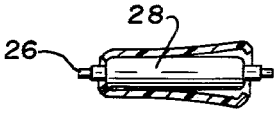
FIG. 5 represents a side view, partly in section, of a spring pivot pin retainer sleeve of FIG. 4 assembled to the pivot pin with the retainer sleeve shown in section.

Referring next to the drawing, particular attention is made to the embodiment of FIGS. 1 through 6. A wrist watch generally identified as 20 has ears 22 in which are formed sockets 24 for the insertion and retention of pin end 26 of a spring pivot retainer 28. The construction of the spring pivot retainer 28 is fully seen and described with reference to FIG. 4 of U.S. Pat. No. 1,696,577 above referenced. This spring pivot retaining 28 is mounted in a loop end 30 of a strap 32 and is prevented from accidental loss or disassembly by a jeweler or attendant who uses a retainer 34 that is preferably of plastic or thin stainless steel.

Tubing 40 may be produced in a continuous and conventional manner. This tubing is preferably of rigid plastic of a thin wall such as three thousandths of an inch thickness. Stainless steel may also be used for this retainer. No matter the composition, the tubing is cut to a prescribed length as indicated by cut lines 42. A prescribed length has both ends inwardly formed or turned as at 44. Also shown in FIG. 3, a slit or slot 46 is made from one end. This cut end is expanded as in FIGS. 4 and 5. The sleeve 34 is shown as being expanded by a tapered tool 48 which enters the right end of the tubing 40 to urge the slit end outwardly so that the portions of the right end are sufficiently expanded for insertion of a pivot retainer 28. This tapered tool 48 is shown as forming the sleeve which is expanded outwardly. The sleeve, when formed for use and expanded at its right end, is identified as 34. This retainer 34 is manipulated so that the right end is in way of the pivot pin which is then moved from right to left.

Figure 6:
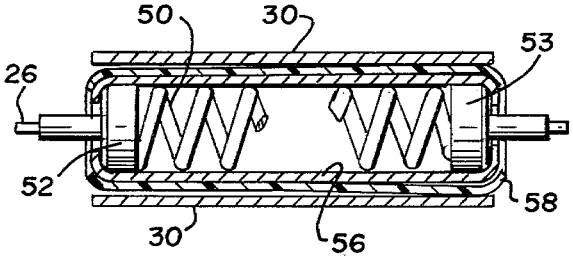
FIG. 6 represents in an enlarged sectional side view a showing of the spring pivot pin of FIG. 5 mounted in an end loop of a watch band.

Embodiment of FIG. 6

The sectional view of FIG. 6 represents, in an enlarged scale, the pin end 26 in which the retainer 34 is shown in section with a compression spring 50 disposed between pin ends 52 and 53. Each end has a reduced diameter end portion which is sized to seat in sockets 24 formed in each ear 22. These ends are slidable in metal retainer 56 which has each end formed or provided with an inwardly turned flange 58. (see FIGS. 3 and 4) This metal outer retainer 56 has a thin sleeve retainer 34 which has both ends also formed with an inwardly formed end 44. The left end of this sleeve member 34 has no cuts or deformations and is a slide fit in the loop end 30 of the strap. The other end of this safety sleeve is formed with at least one slit 46 and for at least one-half of its length. Inserted, this sleeve becomes a tight fit of both the spring pin pivot member 28 and the sleeve 34 in the loop end 30.

Figure 7:
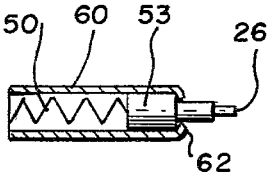
FIG. 7 represents a fragmentary side sectional view of an alternate construction of a pivot pin.
Figure 8:
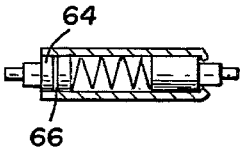
FIG. 8 represents a sectional side view of the pivot pin of FIG. 7 in a further assembly stage.
Figure 9:
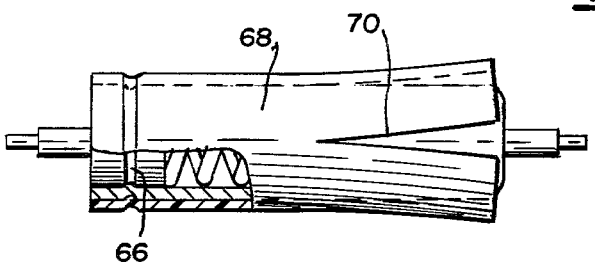
FIG. 9 represents an enlarged side view, partly in section and diagrammatic and showing an alternate spring pivot pin and retaining sleeve assembly.

Alternate Embodiment of FIGS. 7, 8 and 9

The sleeve and pivot pin may be made as a single unit and sold and used as such. When this is to occur the compression spring 50 need not move both end members. For this assembly the right pin end 53 is slidable in a metal tube 60 having its right end formed with an inwardly turned flange 62. An opposite or left end pin member 64 has a shallow groove 66 formed in its mid-length of the larger diameter portion. Before this end member 64 is secured in place an outer sleeve 68 is placed on the metal tube.

The right end of this sleeve is secured by a crimping of the outer sleeve 68 and the tubular member 60 to the pin member 64. The outer sleeve 68 has been previously formed with at least one slit 70 with the outer sleeve spread to provide a spring actuated interference fit of the sleeve in the band end loop 30. The outer sleeve in FIG. 9 is shown with an absence of inturned flange end portions such as 44, seen in FIG. 3. When the safety sleeve is secured in place the flange ends are not required although expanded and extending leaf portions are required for retention of the sleeve in the loop.

Although the drawings and the discussion thereof anticipates that the safety sleeve is either slid into place or secured in place on the pivot pin post by crimping, the use of adhesive is also contemplated. The fixing of a safety sleeve on the pivot pin post removes the necessity of inwardly formed flanges on the ends of a safety sleeve member but these inwardly formed ends assist in the mounting of the pivot pin post in a loop end of a band or strap. No matter the material from which the safety sleeve is made, it is contemplated that it will have as useful a life as the pivot pin post and will not be adversely affected by moisture, heat or other factors. The safety sleeve needs be sufficiently rigid so that the outwardly extending leaf portions will expand into the interior of the loop and engage the loop sufficiently so the sleeve is retained therein while slidable in the loop. The several FIGS. of the drawing show the leaf portion or portions extending outwardly from the tubular body and for the sake of description and claiming this is defined as a delta configuration.

The expansible sleeve used with the spring pin has a very thin wall since it must be used with a pivot pin and band loop of conventional size. The spring pin pivot usually employed is a loose fit in the loop of the strap to insure easy insertion and disassembly. The expansive end of said sleeve retainer allows insertion without undue insertion pressure on the pin retainer. The sleeve is contemplated to be of rigid plastic and of a tubular extrusion having a thin wall such as three thousandths of an inch in thickness. The splitting of an end and expanding a portion into outwardly directed leaf portions may employ one or more slits. Plural slits are easier to manufacture but are merely a matter of preference. Steel, brass or other metal tubing may also be provided since the weight of each sleeve and its formed end is a small fraction of an ounce. Stainless steel, either as a drawn or rolled tube, is also contemplated. Whatever the material, the expansible sleeve has leaf portions adapted to enter the inner diameter of the loop end 30 of the strap 32 and to be a press fit in this loop while retaining the pivot pin in position.

Although an expanding band 32 is shown with loops 30 at each end thereof, the use of pivot pin posts for securing straps of leather, mesh or fabric is also known. The use of the safety sleeve in such watch retaining means is also contemplated.

Terms such as "left", "right", "front", "back", "in", "out", and the like are applicable to the embodiments shown and described in conjunction with the drawing. These terms are merely for the purposes in which the safety sleeve and retainer may be constructed or used.

While particular embodiments of said retainer has been described it is to be understood that modifications may be made within the scope of the accompanying claims and protection is sought to the broadest extent the prior art allows.

What is claimed is:

1. A safety sleeve and retainer in combination with a pivot pin post having reduced end portions adapted to enter and be retained in apertures provided in opposed ear portions of a wrist watch case, said safety sleeve and pivot pin post adapted to pass through a loop end as provided and formed in a wrist watch band or strap, the pivot pin post having larger pin ends sized and adapted to be received by a tubular rigid sleeve with said larger pin end slidable in said tubular rigid sleeve and urged to an outward limit by a compression spring carried within said rigid tubular sleeve, the end of the rigid tubular sleeve being turned inwardly when and where the larger pin end is slidably mounted, said pivot pin post and safety sleeve as an assembly mountable in opposed ear portions of a wrist watch case, said safety sleeve and retainer including in its construction and configuration;

(a) a tubular outer member having a thin wall and of at least a semi-rigid composition and of selected length;

(b) an inturned end formed on an entering end of the tubular outer member and providing means for securing and retaining said tubular outer member to the outer diameter of said pivot pin post and with a determined overall length less than the distance between opposed ear portions of said wrist watch case, said means including forming this tubular outer member with a snug first end portion, and (c) at least one expanded and outwardly extending leaf formed in a second end portion of said tubular outer member, said safety sleeve as and when the pivot pin post is mounted within said safety sleeve being a slide fit in said loop end in the wrist watch strap and with the expanded leaf portion a snugly slidable interference fit within said loop end while preventing loss and/or displacement of the pivot pin post and safety sleeve because of clearance between the inner diameter of the loop end and outer diameter of the pivot pin post.

2. A safety sleeve and retainer as in claim 1 in which the safety sleeve is of substantially rigid thin plastic tubing, one end of the safety sleeve providing a configuration with a snug fit for about one-half of its length and with the remaining safety sleeve split to provide an expanding area to form the outwardly extending leaf.

3. A safety sleeve and retainer as in claim 2 in which there are two splits to provide substantially equally expanded leaf portions.

4. A safety sleeve and retainer as in claim 1 in which the tubular outer member is a sleeve of stainless steel, one end of said tubular outer sleeve providing a configuration with a snug fit for about one-half of its length and with the remaining safety sleeve split to provide an expanding area to form the outwardly extending leaf.

5. A safety sleeve and retainer as in claim 4 in which there are two splits to provide substantially equally expanded leaf portions.

6. A safety sleeve and retainer in combination with a pivot pin post having reduced end portions adapted to enter and be retained in apertures provided in opposed ear portions of a wrist watch case, said safety sleeve and pivot pin post adapted to pass through a loop end in a wrist watch band or strap, the pivot pin having larger pin ends sized and adapted to be received by a tubular rigid sleeve with one end of the larger pin ends slidable in said tubular rigid sleeve and with said slidable larger end urged to its outward limit by a compression spring carried within said rigid tubular sleeve, the fixed end of the pivot pin post having a larger end formed with a narrow and shallow groove and with the tubular outer sleeve secured at this fixed end by crimping the outer sleeve in the groove formed in the larger pin end, the other larger pin end slidable in said rigid sleeve and urged to its outward limit by a compression spring carried within said rigid tubular sleeve, said end of the rigid sleeve retaining the slidable larger pin end being turned inwardly to provide a limited outward motion, said pivot pin post mountable in apertures formed in opposed ears of a wrist watch case, said safety sleeve and retainer including in its construction and configuration:

(a) a tubular outer member having a thin wall and of at least a semi-rigid composition of selected length;

(b) a crimping of an end of the safety sleeve in the crimp of the tubular rigid sleeve in or at the shallow groove in the fixed larger pin end, the overall length of the tubular rigid sleeve less than the distance between the ears of said watch case, said means including forming said tubular outer member with a snug fit first end portion, and (c) at least one expanded and outwardly extending leaf formed in a second end portion of said tubular outer member, said safety sleeve as and when the pivot pin post is mounted within said sleeve being a slide fit in said loop end and with the expanded leaf portion a snugly slidable interference fit within said loop of the strap while preventing unwanted loss and/or displacement of the pivot pin post and safety sleeve through clearance between the inner diameter of the loop end and outer diameter of the pivot pin post.

7. A safety sleeve and retainer as in claim 6 in which the split is made in said outer sleeve at about one-half the length of the sleeve and there are two slits to provide substantially equally expanded leaf portions.

* * * * *